US007146684B2

(12) United States Patent
Hirtsiefer

(10) Patent No.: US 7,146,684 B2
(45) Date of Patent: Dec. 12, 2006

(54) RETENTION ELEMENT

(75) Inventor: Artur Hirtsiefer, Neunkirchen-Seelscheid (DE)

(73) Assignee: Huwil-Werke GmbH Mobelscholoss-und Beschlagfabriken, Ruppichteroth (DE)

( * ) Notice: Subject to any disclaimer, the term of this patent is extended or adjusted under 35 U.S.C. 154(b) by 0 days.

(21) Appl. No.: 11/105,509

(22) Filed: Apr. 14, 2005

(65) Prior Publication Data

US 2005/0211529 A1 Sep. 29, 2005

Related U.S. Application Data

(63) Continuation of application No. PCT/EP2003/007862, filed on Jul. 18, 2003.

(30) Foreign Application Priority Data

Oct. 16, 2002 (DE) ..... 102 48 321

(51) Int. Cl.
*E05C 17/34* (2006.01)

(52) U.S. Cl. ..... 16/339; 16/319

(58) Field of Classification Search ..... 16/319, 16/326, 231, 233, 327–329, 257, 277, 337, 16/342, 375, 339; 403/92, 93, 102, 96–98, 403/329, 330; 49/371, 386
See application file for complete search history.

(56) References Cited

U.S. PATENT DOCUMENTS 3,315,298 A * 4/1967 Strien et al. ..... 16/328
3,737,946 A * 6/1973 Giuliani ..... 16/325
4,087,885 A * 5/1978 Gillentine ..... 16/325
5,123,768 A * 6/1992 Franklin ..... 403/96
5,377,368 A * 1/1995 Cheng ..... 5/99.1
5,791,804 A * 8/1998 Cheng ..... 403/97
6,112,370 A * 9/2000 Blanchard et al. ..... 16/325
6,397,433 B1 * 6/2002 Chen ..... 16/327
6,503,018 B1 * 1/2003 Hou et al. ..... 403/97

(Continued)

FOREIGN PATENT DOCUMENTS

DE 1757037 11/1957

(Continued)

*Primary Examiner*—Robert J. Sandy
*Assistant Examiner*—Andre' L. Jackson
(74) *Attorney, Agent, or Firm*—Sughrue Mion, PLLC

(57) ABSTRACT

Retention element, especially a lid stay or a flap holder, comprising a first arm, having a first friction face, a second arm, connected pivotably around an articulation axis to the first arm, an operating element and a locking element, forming a locking face, wherein the locking unit is arranged to the second arm, a braking element, having a braking face, to which the locking face is held in frictional contact, and having a second friction face, which is held at least indirectly in abutment to the first friction face, wherein the operating element, in a first rotational direction of the arms relative to each other, urges the locking face against the braking face, wherein in the first rotational direction of the two arms relative to each other the maximal braking torque between the locking face and the braking face is larger than the maximal frictional torque between the first friction face and the second friction face, wherein in a second rotational direction of the two arms relative to each other the maximal braking torque between the locking face and the braking face is smaller than the maximal frictional torque between the first friction face and the second friction face and wherein the maximal frictional torque in the first rotational direction of the two arms relative to each other is larger than the maximal braking torque in the second rotational direction of the two arms relative to each other.

14 Claims, 13 Drawing Sheets

U.S. PATENT DOCUMENTS

| | | | | |
|---|---|---|---|---|
| 6,539,584 | B1 * | 4/2003 | Gillotti | 16/371 |
| 6,789,848 | B1 * | 9/2004 | Rauschenberger et al. | 297/369 |

FOREIGN PATENT DOCUMENTS

| | | | |
|---|---|---|---|
| DE | 18 58 565 | | 7/1962 |
| DE | 1255534 | | 1/1963 |
| DE | 19 61 917 | | 2/1967 |
| DE | 2821761 | C2 | 1/1979 |
| DE | 19623405 | A1 | 12/1997 |
| DE | 10019336 | A | 10/2001 |
| EP | 1209308 | A | 5/2002 |
| GB | 163869 | A | 6/1921 |

* cited by examiner

RETENTION ELEMENT

This is a Continuation of International Application PCT/EP2003/007862, with an international filing date of Jul. 18, 2003, which was published under PCT Article 21(2) in German, and the disclosure of which is incorporated into this application by reference.

BACKGROUND OF THE INVENTION

The invention relates to a retention element having a first arm and a second arm, which are pivotably connected to each other around a joint axis. The retention ele-ment can be used for retaining a lid, which opens upwards, and a flap opening downwards. For this, a free end of one of the two arms is connected to the carcass of a furniture piece and a free end of the respectively other arm is connected to the flap or the lid.

DE 197 17 189 C2 describes a retention element, in which in a first rotational direction of the two arms relative each other a higher torque has to be produced than in a second rotational direction. Thus, for example, when used as a lid stay, it is ensured, that when opening the lid a smaller torque has to be overcome than when closing the lid. When closing the lid, the to be produced torque for turning the two arms is larger than the torque, which is produced by the weight of the lid onto the retention element. Thus, it is ensured, that the lid is retained in any position. However, because of the lower torque, when opening the lid, an easier opening is ensured.

For this, a friction ring with a complete circumferential outer toothing is provided, which is arranged in frictional contact to the first arm and is arranged rotatably around the joint axis relative to the first arm. A ring of the second arm is arranged around the friction ring and has a partial circumferential inner toothing, which can be brought into engagement and out of engagement with the complete circumferential outer toothing of the friction ring. In the first rotational direction of the arms relative to each other the toothings are in engagement, so that the friction ring is rotated with the second arm relative to the first arm. Thus, a frictional torque has to be overcome because of the frictional contact between the friction ring and the first arm. In the second rotational direction the toothings are out of engagement, wherein the second arm is freely movable around the friction ring. Here, only a smaller torque is neces-sary for rotating the arms relative to each other.

Disadvantageous is however, that when moving the toothings, to bring these into engagement, a small rotational movement has to be carried out in the first rotational direction, which leads to a slight lowering of the lid or of the flap.

SUMMARY OF THE INVENTION

The object of the present invention is, to provide a retention element, in which a small free motion, when changing the rotational direction, is ensured.

The object according to the invention is solved by a retention element, especially a lid stay or a flap holder, comprising a first arm, having a first friction face, a second arm, connected pivotably around an articulation axis to the first arm, locking unit, having an operating element and a locking element, forming a locking face, wherein the locking unit is arranged to the second arm, a braking element, having a braking face, to which the locking face is held in frictional contact, and having a second friction face, which is held at least indirectly in abutment to the first friction face, wherein the operating element, in a first rotational direction of the arms relative to each other, urges the locking face against the braking face, wherein in the first rotational direction of the two arms relative to each other the maximal braking torque between the locking face and the braking face is larger than the maximal frictional torque between the first friction face and the second friction face, wherein in a second rotational direction of the two arms relative to each other the maximal braking torque between the locking face and the braking face is smaller than the maximal frictional torque between the first friction face and the second friction face and wherein the maximal frictional torque in the first rotational direction of the two arms relative to each other is larger than the maximal braking torque in the second rotational direction of the two arms relative to each other.

Furthermore, the object is solved by a retention element, especially a lid stay or a flap holder, comprising a first arm, to which a first friction face is arranged, a second arm, connected pivotably around an articulation axis to the first arm, a locking unit, having an operating element, a locking element, forming a locking face, and a second friction face, which is held at least indirectly in abutment to the first friction face, a braking element, having a braking face, to which the locking face is held in frictional contact, wherein the braking element is arranged to the second arm, wherein the operating element, in a first rotational direction of the arms relative to each other, urges the locking face against the braking face, wherein in the first rotational direction of the two arms relative to each other, the maximal braking torque between the locking face and the braking face is larger than the maximal frictional torque between the first friction face and the second friction face, wherein in a second direction of the two arms relative to each other, the maxi-mal braking torque between the locking face and the braking face is smaller than the maximal frictional torque between the first friction face and the second friction face and wherein the maximal frictional torque in the first rotational direction of the two arms relative to each other is larger than the maximal braking torque in the second rotational direction of the two arms relative to each other.

The retention element of both embodiments have, therefore, a braking unit, comprising the locking unit and the braking element. A component of the braking unit is always arranged non-rotationally to the second arm and a further component of the braking unit is always held in frictional contact to the first arm.

In the first embodiment of the retention element, the operating element is arranged non-rotationally to the second arm and the braking element is held in frictional con-tact with the first arm. In this case, the operating element can be formed onto the second arm and, therefore, be formed integrally with the same.

In the second embodiment of the retention element, the braking element is arranged non-rotationally to the second arm and the operating element is held in frictional con-tact with the first arm. In this case, the braking element can be connected non-rotationally with the second arm or can be formed by the second arm. In the latter case, the braking face is formed by an inner circumferential face of a receiving re-cess of the second arm.

As in the first rotational direction the maximal braking torque is larger than the maximal frictional torque, it is ensured, that all components of the braking unit together with the second arm are rotated relative to the first arm. Thus, the two friction faces slide on each other, so that for rotating the two arms relative to each other, the fric-tion torque has to be overcome.

In the second rotational direction, the maximal braking torque is smaller than the maximal frictional torque, so that the two friction faces cannot slide on each other but the locking element is rotated relative to the braking element.

As the frictional torque in the first rotational direction is larger than the maximal braking torque in the second rotational direction, it is ensured, that in the first rotational direction a larger torque has to be overcome than in the second rotational direction.

The locking element can be formed annular and have at one position of its circumference a slot, and can, therefore, be expanded in the circumferential direction. In this case, an outer circumferential face of the locking element can represent the locking face, which is abutting an inner circumferential face of the braking element, which represents the braking face. Therefore, the locking element and the braking element form a type of drum brake.

The locking element can have two brake blocks, which are connected via an elastic connection web to each other and form together the locking face.

To be able to force the locking face in the first rotational direction against the braking face, the operating element has an operating projection, which is supported on a first expanding face and a second expanding face of the locking element. The first ex-panding face is, in this case, arranged on one of the brake blocks and the second expanding face is arranged on the other brake block.

The operating projection can be pivoted relative to the braking element around a pivot axis, which extends parallel to the articulation axis and is arranged between the first expanding face and the second expanding face.

In this case, the operating projection is supported with a first operating face on the first expanding face and with a second operating face on the second expanding face.

The operating faces extend such, that the distance between the support of the first operating face on the first expanding face and the support of the second operating face on the second expanding face, when pivoting the operating element by rotating the arms in the first rotational direction, increases. Therefore, when pivoting the op-erating element by means of a rotation of the arms in the first rotational direction, the expanding faces are pushed away from each other, so that the locking face is urged against the braking face.

For pivoting the operating projection, the complete locking element can be arranged pivotably around the pivot axis relative to the braking element.

Furthermore, the operating element can have a driving projection, which, concerning the articulation axis, is supported relative to the slot at least indirectly in circumferential direction on the locking element. Thus, in the second rotational direction of both arms relative to each other, it is ensured, that the operating element is supported at two opposed positions on the locking element, so that an expanding of the locking element is prevented.

The driving projection can be supported via a spring element on the locking element. Thus, the operating element is basically acted on in that direction, which is produced during the pivoting of the two arms in the first rotational direction. Therefore, it is en-sured, that the locking face is pushed against the braking face without a clearance and a clearance because of manufacturing tolerances or wear is prevented.

BRIEF DESCRIPTION OF THE DRAWINGS

Preferred embodiments are described in more detail by means of drawings. In these it shows

DETAILED DESCRIPTION OF THE INVENTION

Figure 1:
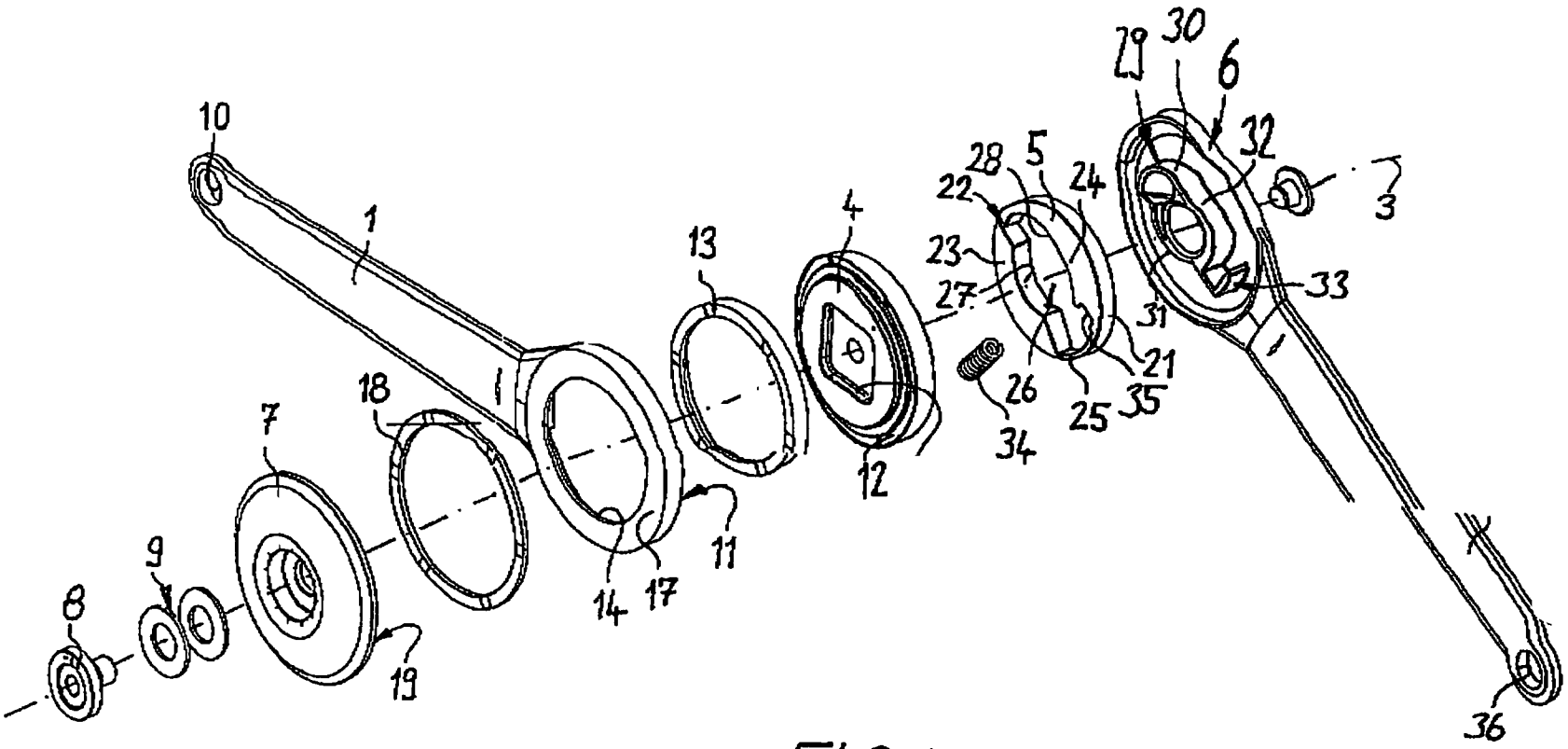
FIG. 1 is a perspective representation of a first embodiment of a retention element according to the invention in an exploded view.

FIGS. 1 to 7 show a first embodiment of a retention element according to the invention and are described together in the following.

The retention element has a first arm 1 and a second arm 2, which are arranged rotatably relative to each other around an articulation axis 3. Between the two arms 1, 2 a braking element 4 is arranged, which interacts with a locking element 5. The locking element 5 is held stationary in a first rotational direction relative to the braking element 4 and is held rotationally thereto in a second rotational direction. For this serves an operating element 6, which acts onto the locking element 5 in the first rotational direction. A lid 7 is connected to the braking element 4 by a screw 8, wherein a bias is adjustable via a Belleville spring washer packet 9.

Figure 3:
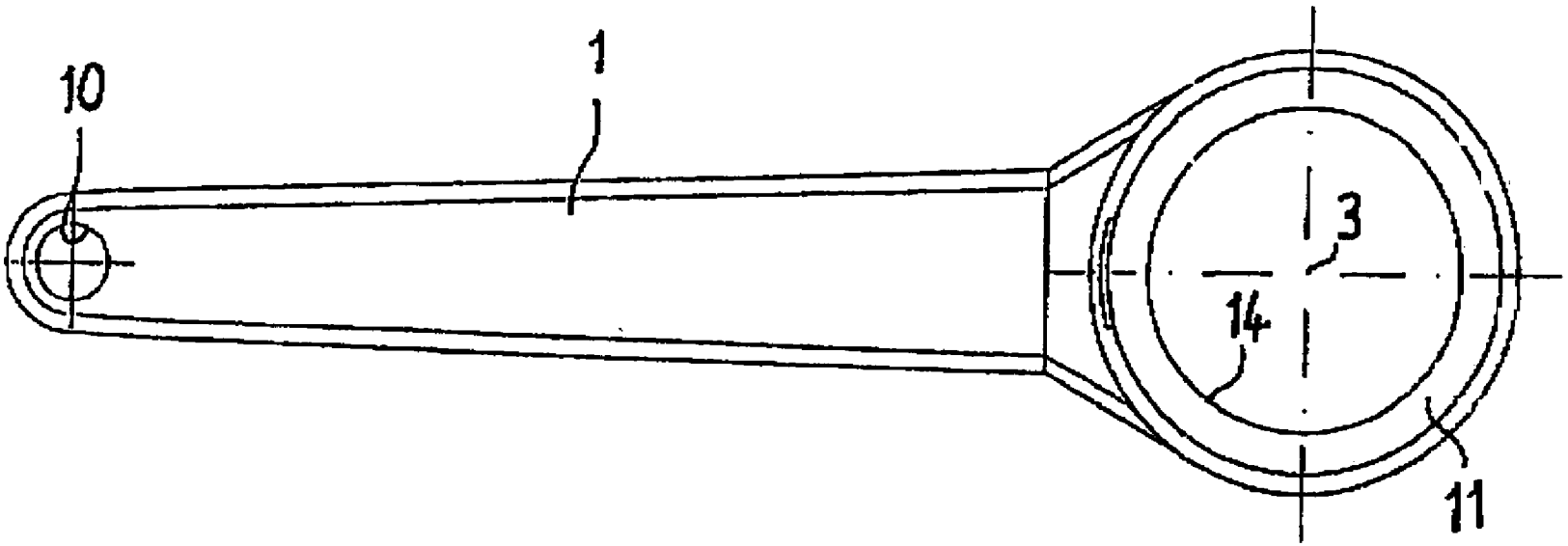
FIG. 3 is a plan view of the first arm of FIG. 1.

FIG. 3 shows the first arm 1, having at one of its free ends a first attachment bore 10, to be able to connect attachment means to the arm 1. The attachment means serve for connecting the first arm 1 to a lid, a flap or the carcass of a furniture piece. Further, at the other end of the first arm a circular annular first friction face 11 is formed, which is arranged coaxially to the articulation axis 3 and is facing the braking element 4.

Figure 4:
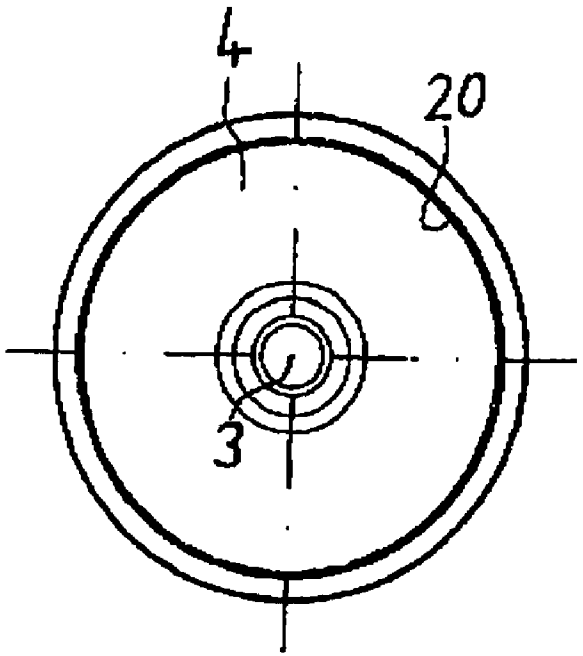
FIG. 4 is a plan view of the braking element of FIG. 1.

The braking element 4, shown in FIG. 4, has a second friction face 12, which is facing the first friction face 11 and is supported on the same via a first friction ring 13.

Figure 2:
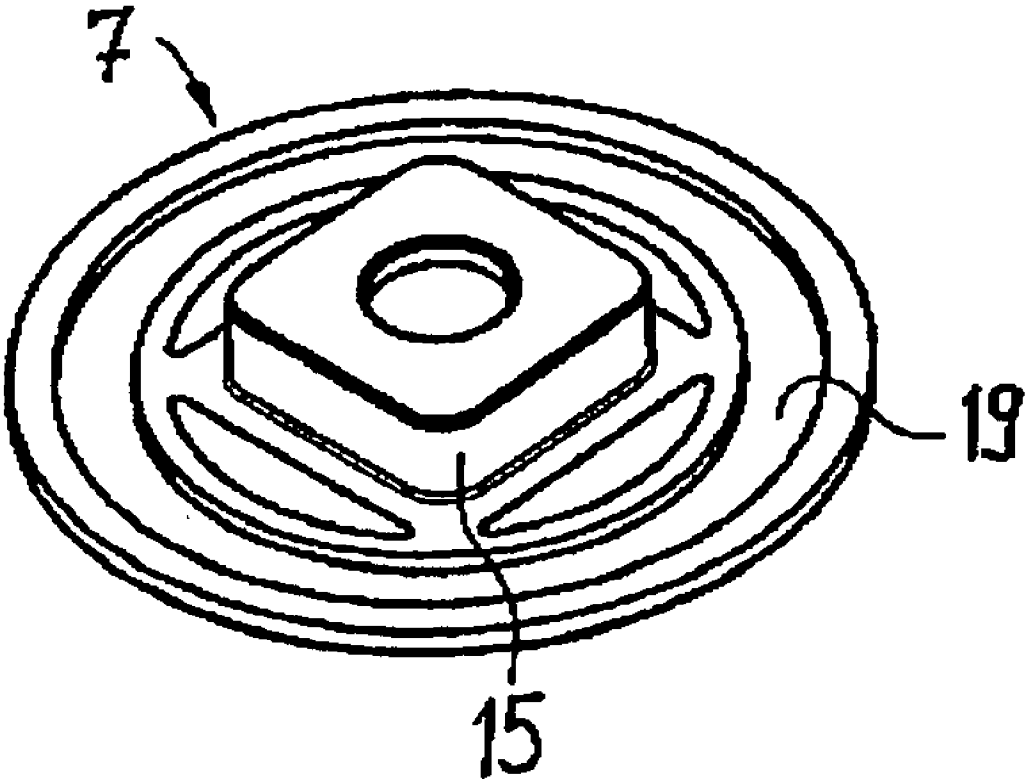
FIG. 2 is a perspective representation of the lid of FIG. 1.

Through a central bore 14 of the first arm 1 a connection projection of the lid 7 shown in FIG. 2 is passed. The connection projection 15 has a profile deviating from a circle and which engages axially a connection recess 16 of the braking element 4 formed mating thereto. The lid 7 and the braking element 4 are, therefore, held non-rotationally relative to each other. At the first arm 1 a third friction face 17 is formed, which is facing the first friction face 11 and which abuts by means of a second friction ring 18 a fourth friction face 19, which is formed by the lid 7. By means of the screw 8, the braking element 4 and the lid 7 are biased against the first arm 1.

Figure 5:
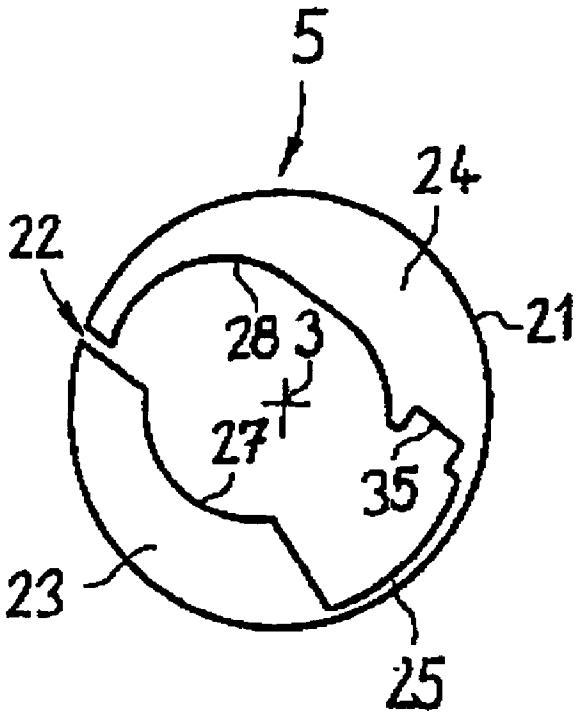
FIG. 5 is a plan view of the locking element of FIG. 1.

The braking element 4 is formed pot-like and has a braking face 20 in form of an inner circumferential face. Within the braking element 4 the locking element 5, shown in FIG. 5, is arranged. This forms a locking face 21 in form of an outer circumferential face, which is in frictional contact with the braking face 20. The locking element 5 is formed annular and has on its circumference a slot 22, so that the locking element 5 can be expanded in the circumferential direction. For this, the locking element 5 forms a first brake block 23 and a second brake block 24, which are connected by an elastic connection web 25 to each other. Therefore, the brake blocks 23, 24 can be moved away from each other.

Furthermore, the locking element 5 forms a central recess 26, which forms a first expanding face 27 on the first brake block 23 and a second expanding face 28 on the second brake block 24.

Figure 6:
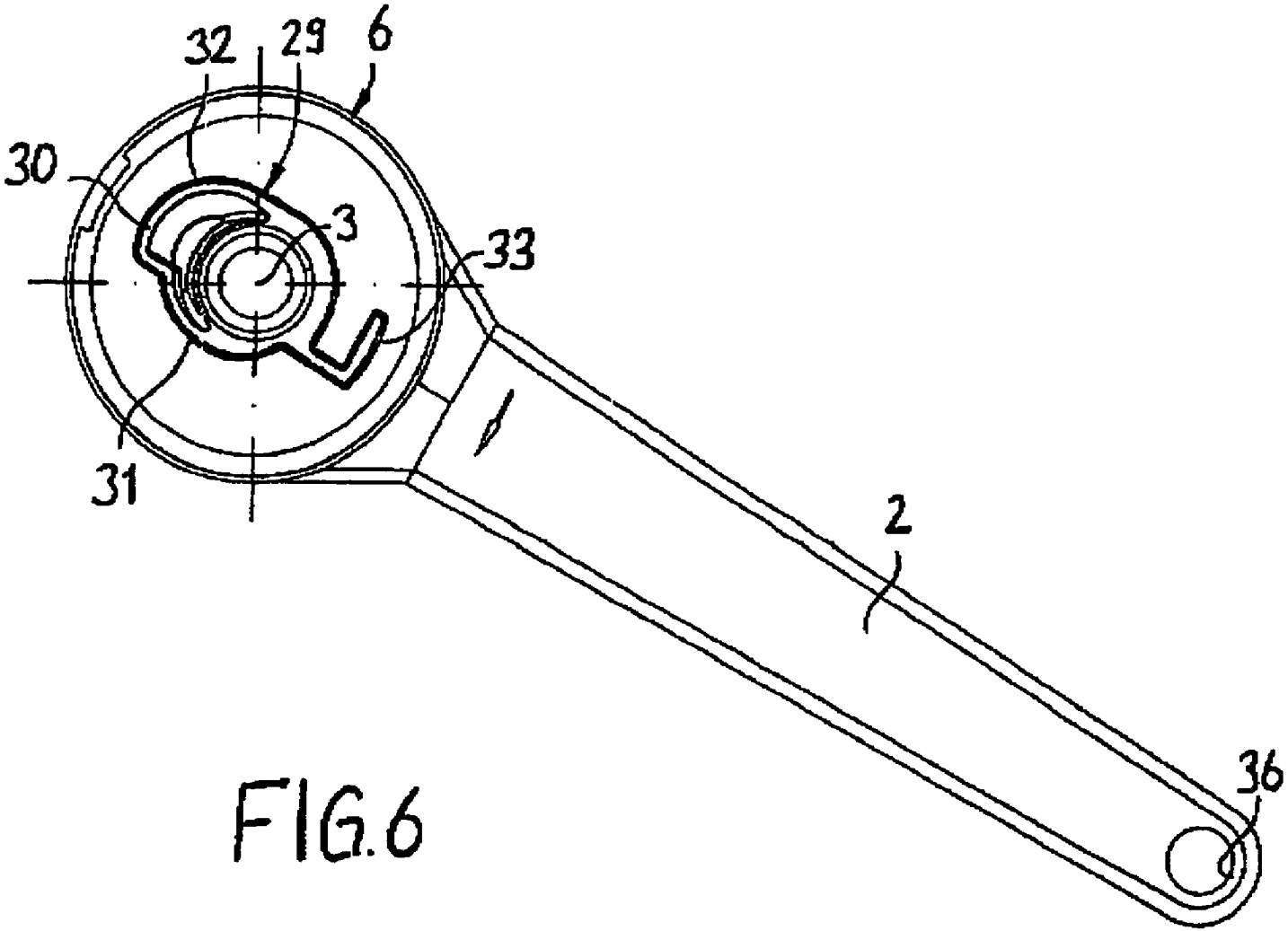
FIG. 6 is a plan view of the second arm with the operating element of the retention element of FIG. 1.

The operating element 6 engages with an operating projection 30 in the recess 26. The operating element 6 is, as shown in FIG. 6, formed onto the second arm 2. The operating projection 30 has an outer face 29, forming a first operating face 31 and a second operating face 32. The first operating face 31 is held in abutment with the first expanding face 27 and the second operating face 32 is held in abutment with the second expanding face 28.

Furthermore, the operating element 6 has a driving projection 33, which also en-gages in the recess 26 of the locking element 5. The driving projection 33 is sup-ported via a spring 34 on a driving face 35 on the second brake block 24. The sup-port of the driving projection 33 on the driving face 35 is, here, in relation to the articulation axis 3, arranged opposed to the slot 22.

In the first rotational direction of the two arms 1, 2 relative to each other, the locking element 5 is acted on relative to the braking element 4 around a pivot axis in the direction of a first pivot direction, wherein the pivot axis is arranged between the first expanding face 27 and the second expanding face 28. The outer face of the operating projection 30 is formed such, that the distance of the support of the first operating face 31 on the first expanding face 27 and of the support of the second operating face 32 on the second expanding face 28, when pivoting the locking element 5 relative to the braking element 4 in the first pivot direction, increases. Therefore, the two expanding faces 27, 28 and therefore, the two brake blocks 23, 24 are pushed away from each other, so that the locking face 21 is acted upon radially to the outside against the braking face 20.

The braking torque between the locking face 21 and the braking face 20 is here dimensioned that large, that the locking element 5 and the braking element 4 are held stationary to each other. Therefore, the braking element 4 and the locking element 5 are held non-rotationally to the second arm 2 and rotate with the same in the first rotational direction relative to the first arm 1. Hereby, a frictional torque is effective, which is produced, because of the friction faces 11, 12, 17, 19 sliding on each other.

When rotating the two arms 1, 2 in the second rotational direction relative to each other, the operating element 4 is acted upon in the direction of a second pivoting direction around the pivot axis, wherein the first operating face 31 is urged against the first expanding face 27 and the driving projection 33 is urged against the driving face 35 on the second brake block 24. An expanding of the locking element 5 is, there-fore, prevented, so that the locking element 5 is rotated relative to the brake element 4. The braking torque between the locking face 21 and the braking face 20 is, here, smaller than the frictional torque between the friction faces 11, 12, 17, 19. As, furthermore, the braking torque in the second rotational direction is smaller than the frictional torque in the first rotational direction, it is ensured, that for rotating the two arms 1, 2, in the first rotational direction, a larger torque has to be overcome than in the second rotational direction.

Figure 7:
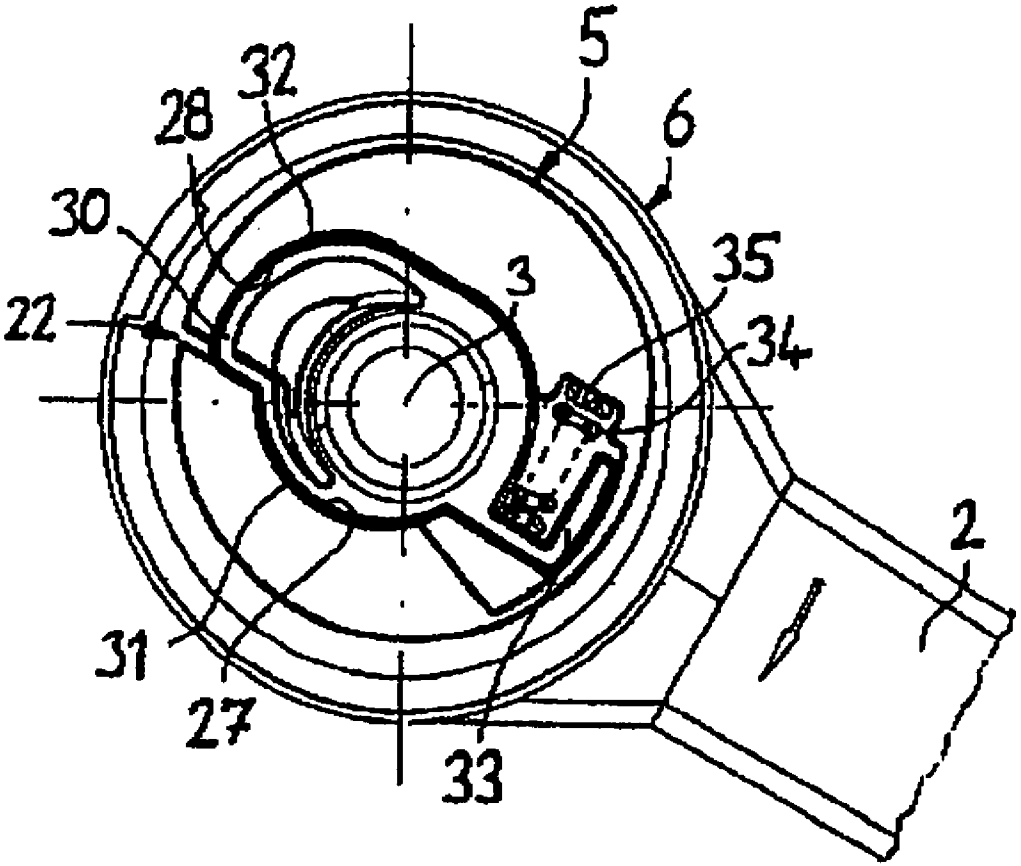
FIG. 7 is a plan view of the braking element and the locking element of FIG. 1 in the assembled condition.
Figure 8:
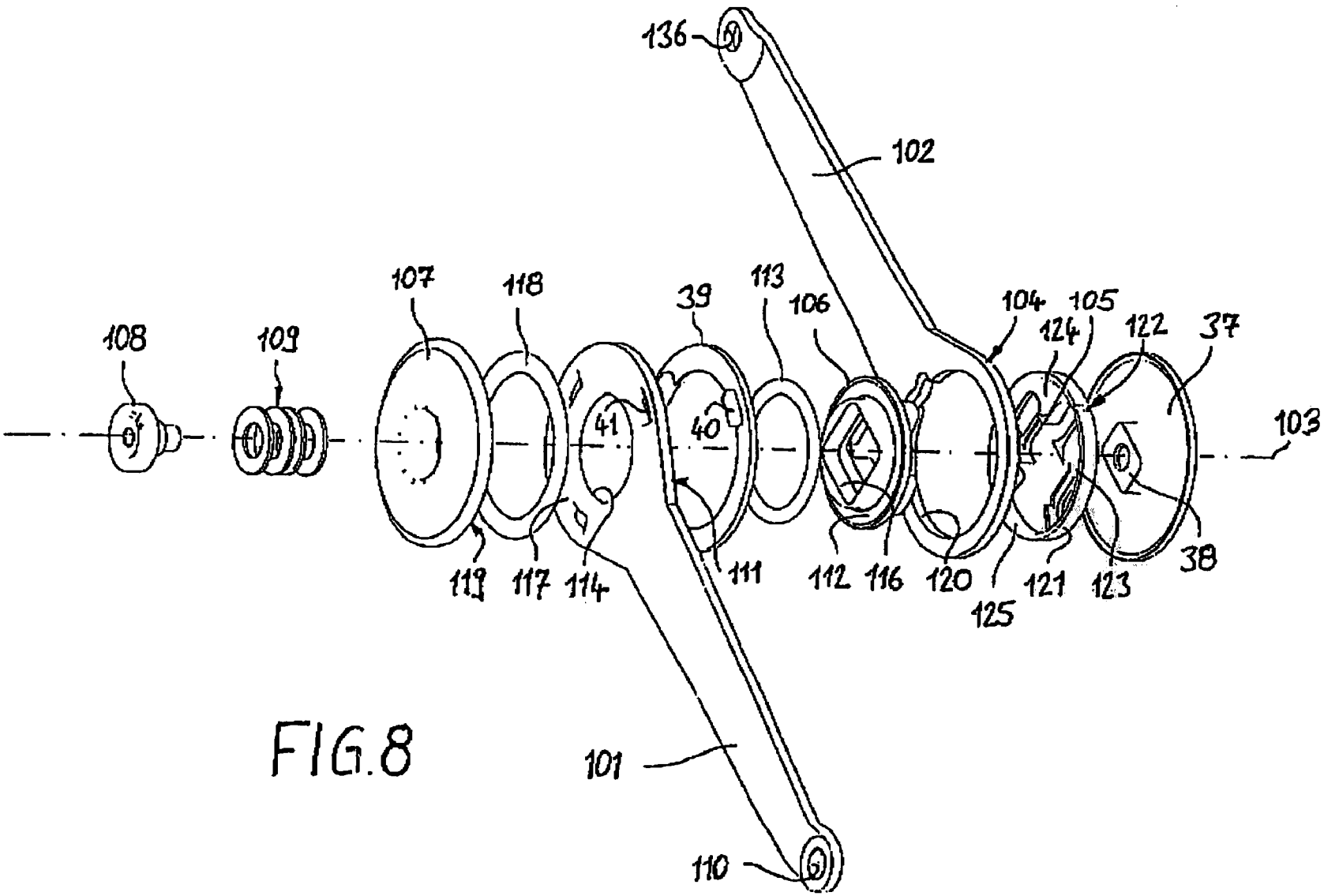
FIG. 8 is a perspective representation of a second embodiment of a retention element according to the invention in an exploded view.
Figure 9:
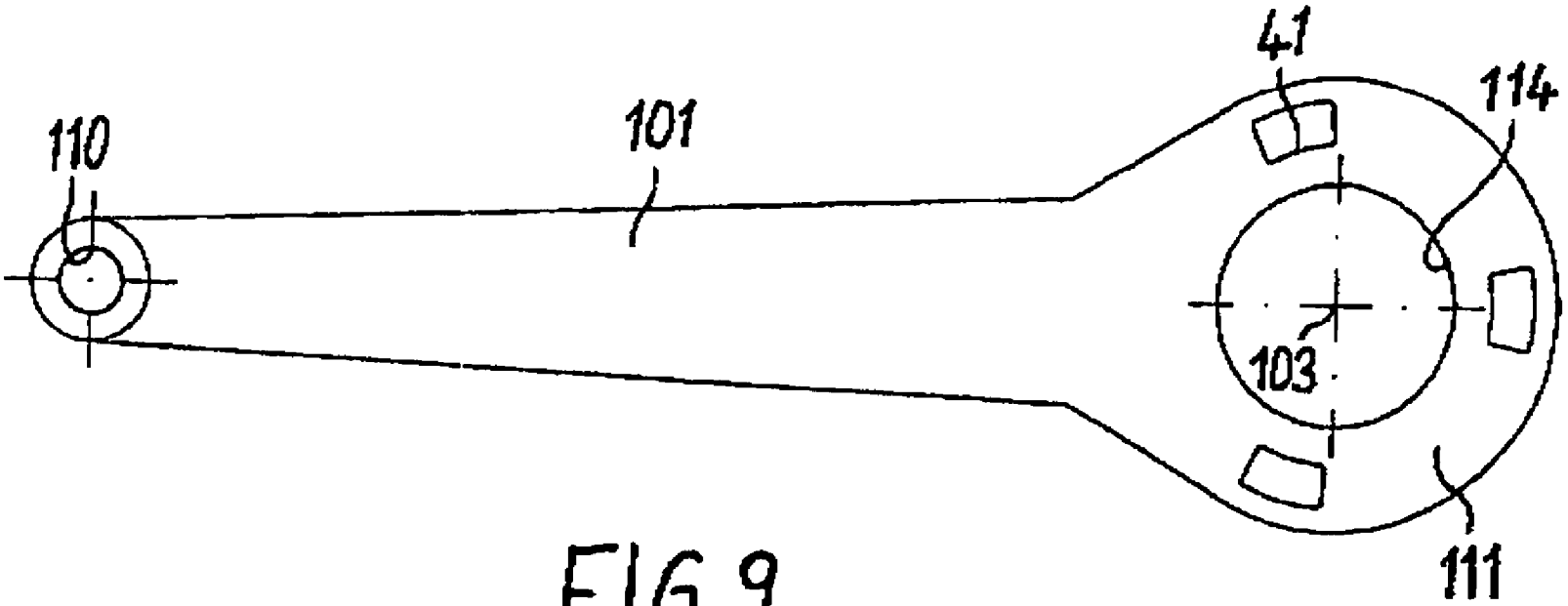
FIG. 9 is a plan view of the first arm of FIG. 8.
Figure 10:
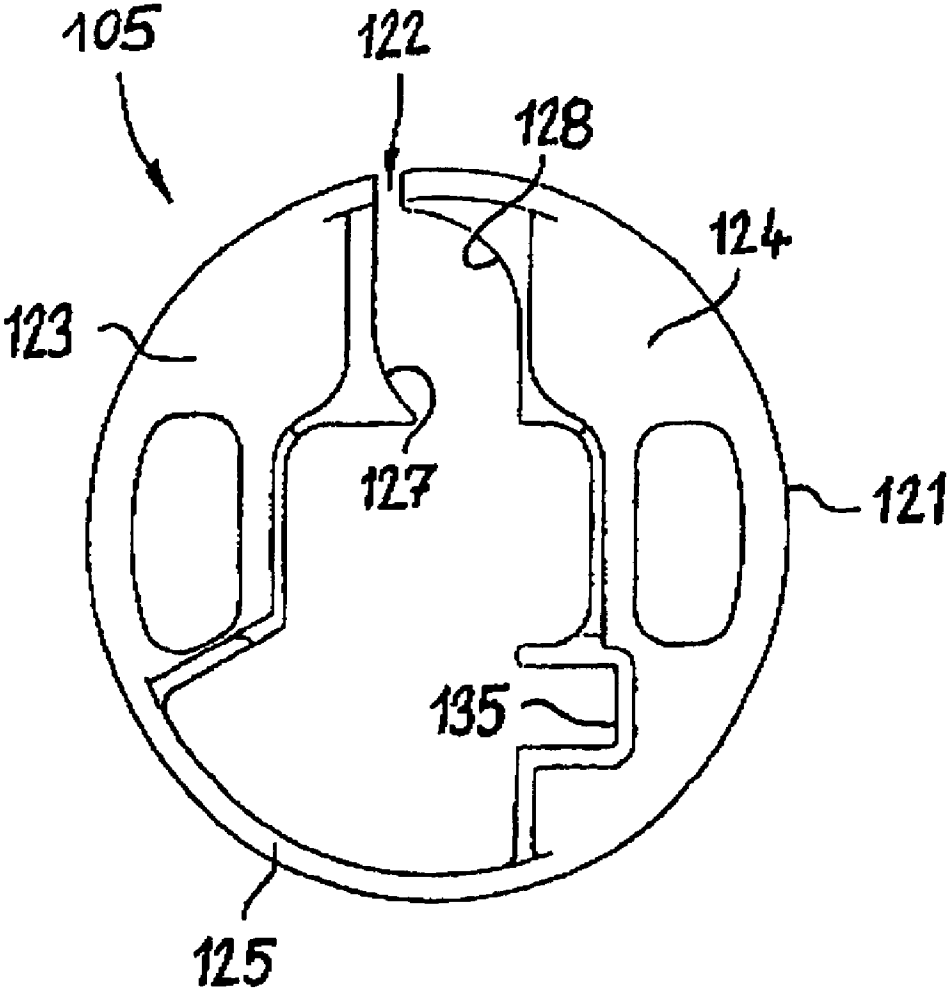
FIG. 10 is a plan view of the locking element of FIG. 8.
Figure 11:
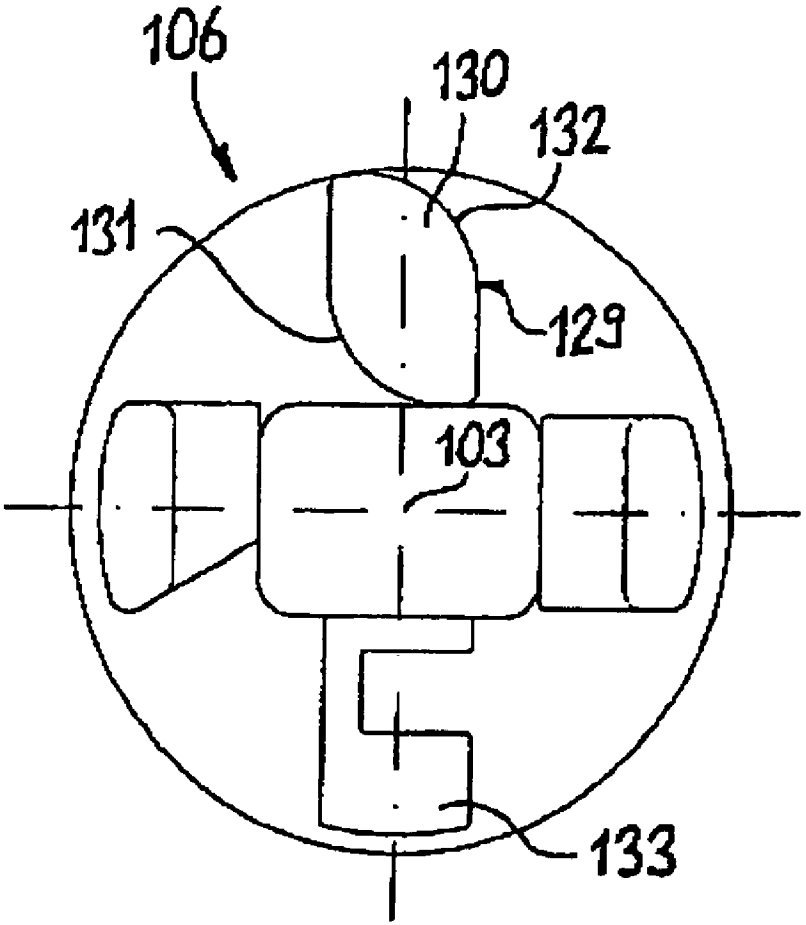
FIG. 11 is a plan view of the operating element of FIG. 8.
Figure 12:
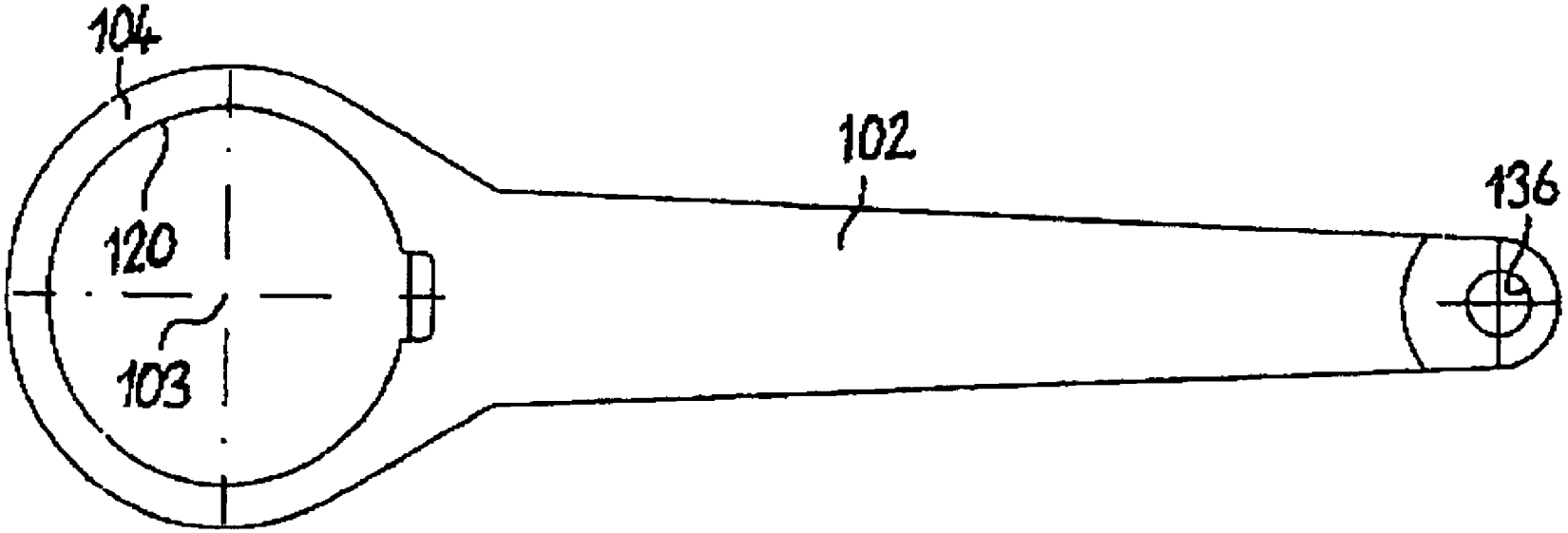
FIG. 12 is a plan view of the second arm of FIG. 8.
Figure 13:
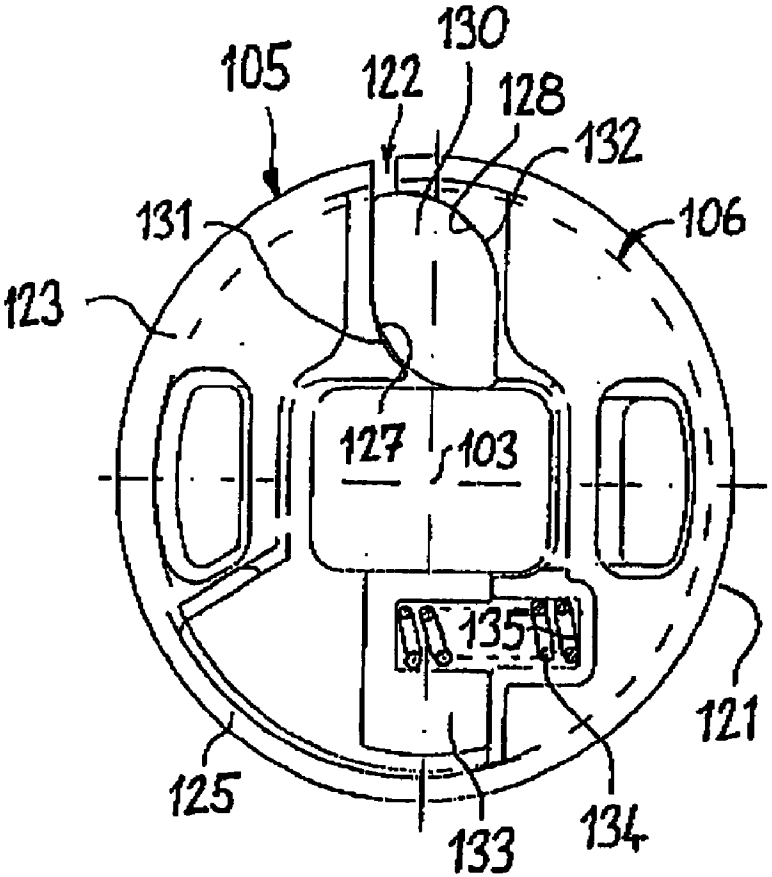
FIG. 13 is a plan view of the operating element and the locking element of FIG. 8 in the assembled condition.

The spring 34 biases the locking element 5 in the direction towards the first pivot axis relative to the braking element 4, so that it is always ensured, that the locking face 21 is in contact to the braking face 20, to prevent a clearance because of manufacturing tolerances or wear. In FIG. 7 it is also visible, that the locking element 5 and the operating element 6 are off-set transversally to the articulation axis 3 relative to each other. During the use the locking element 5 and the operating element 6 will reach because of wear a concentric position relative to each other. During further wear, the two elements take up again an off-set, which is opposite to the displacement, shown in FIG. 7.

To connect pivotably the second arm 2 to a carcass or a lid or a flap, the second arm 2 has at its free end a second attachment bore 36, via which the second arm can be connected to attachment means.

In FIGS. 8 to 13 a second embodiment of a retention element according to the invention is shown. Components, which correspond to components of the first embodiment, are provided with reference numerals, which are increased by the numerical value 100.

Different to the retention element according to the first embodiment the braking element 4 is formed on the second arm 2, however, the second friction face 112 is pro-vided on the operating element 106. The second arm 2 has an annular end, which forms the braking face 20 by an inner circumferential face of the annulus.

Furthermore, a second lid 37 is provided, which engages with a central projection 38 in the recess 126 of the operating element 6 and is connected by the projection 38 in a non-rotational manner to the operating element 106. Furthermore, between the first arm 101 und the second arm 102 a spacer ring 39 is provided, which is connected via cams 40, engaging in grooves 41 of the first arm 101, in a non-rotational manner to the first arm 101. The spacer ring 39 serves to encapsulate the unit comprising the first friction ring 113, the operating element 106 and the locking element 105 to the outside.

The operation corresponds to that of the first embodiment.

Figure 14:
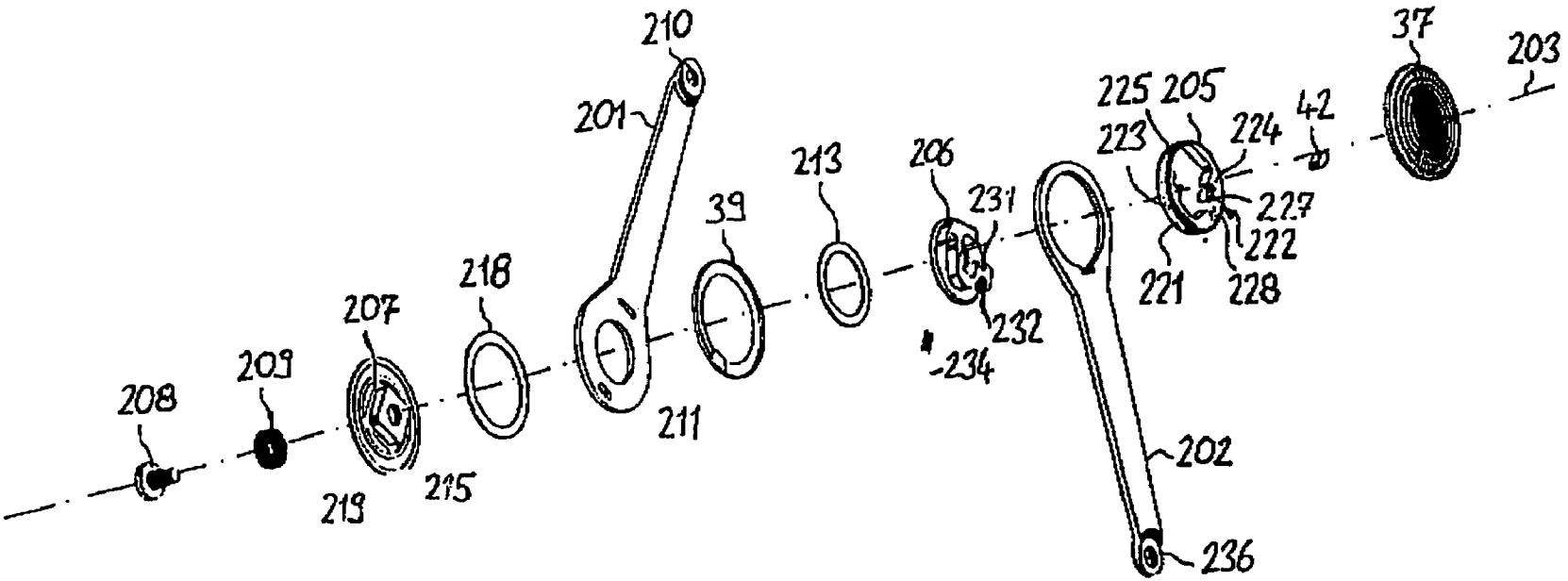
FIG. 14 is a perspective representation of a third embodiment of a retention ele-ment according to the invention in an exploded view.

FIG. 14 shows a third embodiment of a retention element, wherein components, which correspond to components of the second embodiment, are provided with reference numerals, increased by the numerical value 100.

The third embodiment of the retention element is basically formed identical to the second embodiment, wherein between the first operating face 231 of the operating element 204 and the first expanding face 227 of the locking element 205 a pressure element 42 is provided, which serves as a toggle lever. Therefore, when pivoting the locking element 205 relative to the braking element 204, larger forces can be produced, by which the locking face 221 is urged against the braking face 220.

What is claimed is:

1. Retention element, especially a lid stay or a flap holder, comprising;

a first arm, having a first friction face, a second arm, connected pivotably around an articulation axis to the first arm, a locking unit, having an operating element and a locking element, forming a locking face, wherein the locking unit is arranged to the second arm, a braking element, having a braking face, to which the locking face is held in frictional contact, and having a second friction face, which is held at least indirectly in abutment to the first friction face, wherein the operating element, in a first rotational direction of the arms relative to each other, urges the locking face against the braking face, wherein in the first rotational direction of the two arms relative to each other the maximal braking torque between the locking face and the braking face is larger than the maximal frictional torque between the first friction face and the second friction face, wherein in a second rotational direction of the two arms relative to each other the maximal braking torque between the locking face and the braking face is smaller than the maximal frictional torque between the first friction face and the second friction face, wherein the maximal frictional torque in the first rotational direction of the two arms relative to each other is larger than the maximal braking torque in the second rotational direction of the two arms relative to each other, wherein the locking element has an outer circumferential face, which represents the locking face, said locking element being formed annular and being expandable in the circumferential direction, and wherein the braking element has an inner circumferential face, representing the braking face.

2. Retention element according to claim 1, wherein the operating element is formed on the second arm.

3. Retention element according to claim 1, wherein the locking element forms two brake blocks, which are connected via an elastic connection web to each other and form together the locking face.

4. Retention element according to claim 1, wherein the operating element has an operating projection, which is supported on a first expanding face and a second expanding face of the locking element.

5. Retention element according to claim 4, wherein the first expanding face is arranged on first brake blocks and the second expanding face is arranged on the other brake block.

6. Retention element according to claim 4, wherein the operating projection can be pivoted relative to the braking element around a pivot axis, extending parallel to the articulation axis and is arranged between the first expanding face and the second expanding face.

7. Retention element according to claim 6, wherein the operating projection is supported with a first operating face on the first expanding face and with a second operating face on the second expanding face.

8. Retention element according to claim 7, wherein the operating faces extend such that the distance between the support of the first operating face on the first expanding face and the support of the second operating face on the second expanding face increases, when pivoting the operating element by rotating the arms, in the first rotational direction.

9. Retention element according to claim 6, wherein the locking element is pivotable around the pivot axis relative to the braking element.

10. Retention element according to claim 9, wherein the operating element has a driving projection, which concerning the articulation axis is supported relative to the slot at least indirectly in circumferential direction on the locking element.

11. Retention element according to claim 10, wherein the driving projection is supported via a spring element on the locking element.

12. Retention element, especially a lid stay or a flap holder, comprising;

a first arm, to which a first friction face is arranged, a second arm, connected pivotably around an articulation axis to the first arm, a locking unit, having an operating element, a locking element, forming a locking face, and a second friction face, which is held at least indirectly in abutment to the first friction face, a braking element, having a braking face, to which the locking face is held in frictional contact, wherein the braking element is arranged to the second arm, wherein the operating element, in a first rotational direction of the arms relative to each other, urges the locking face against the braking face, wherein in the first rotational direction of the two arms relative to each other, the maximal braking torque between the locking face and the braking face is larger than the maximal frictional torque between the first friction face and the second friction face, wherein in a second direction of the two arms relative to each other, the maximal braking torque between the locking face and the braking face is smaller than the maximal frictional torque between the first friction face and the second friction face, wherein the maximal frictional torque in the first rotational direction of the two arms relative to each other is larger than the maximal braking torque in the second rotational direction of the two arms relative to each other, wherein the locking element has an outer circumferential face, which represents the locking face, said locking element being formed annular and being expandable in the circumferential direction, and wherein the braking element has an inner circumferential face, representing the braking face.

13. Retention element according to claim 12, wherein the braking element is connected non-rotationally to the second arm and that the operating element forms a second friction face.

14. Retention element according to claim 13, wherein the braking element is formed by the second arm, wherein the braking face is formed by an inner circumferential face of a receiving recess of the second arm and that the operating element forms the second friction face.

* * * * *